US005692523A

United States Patent [19]

Croll et al.

[11] Patent Number: 5,692,523

[45] Date of Patent: Dec. 2, 1997

[54] TWO-PIECE MOUTHGUARD

[75] Inventors: Theodore P. Croll, 4242 Mechanicsville Rd., Mechanicsville, Pa. 18934; Philip A. Klann, Waynesboro, Va.

[73] Assignee: Theodore P. Croll, Mechanicsville, Pa.

[21] Appl. No.: 721,313

[22] Filed: Oct. 15, 1996

[51] Int. Cl.[6] ..... A61C 5/14

[52] U.S. Cl. ..... 128/859; 128/861

[58] Field of Search ..... 128/848, 859–862; 2/2

[56] References Cited

U.S. PATENT DOCUMENTS 3,692,025 9/1972 Greenberg ..... 128/861
4,944,313 7/1990 Katz ..... 128/859
4,955,393 9/1990 Adell ..... 128/859
5,154,184 10/1992 Alvarez ..... 128/848

*Primary Examiner*—Michael A. Brown
*Attorney, Agent, or Firm*—Gregory J. Gore

[57] ABSTRACT

A two-piece mouthguard is composed of separate pieces of flat cushioning material which contain pre-formed notches, cutouts and holes that permit the separate pieces to be fitted together into the proper shape and configuration of a mouthguard. A horseshoe-shaped bite plate member includes a pair of left and right curved slots and a frontal interlocking tab joint which secures the bite plate member to a vertical member which after assembly assumes the approximate shape of the dental arch. The vertical member includes a centrally-located slot which receives the interlocking tab on the bite plate member. A handgrip projects from the front of the bite plate member which includes an aperture that may be used to secure a tether.

15 Claims, 2 Drawing Sheets

TWO-PIECE MOUTHGUARD

FIELD OF THE INVENTION

This invention relates in general to mouth protectors and athletic mouthguards. More specifically, it relates to intraoral mouthguards which possess the ability to conform to the shape of the mouth.

BACKGROUND OF THE INVENTION AND DESCRIPTION OF PRIOR ART

Mouthguards are commonly used in contact sports and use is often mandated for athletes because of the probability of severe injury to the mouth and teeth if left unprotected. Mouthguards are often designed specifically to protect both the teeth and gingiva from injury due to external impact.

The prior art includes many different types of mouthguards; for example, the mouthguard disclosed in U.S. Pat. No. 5,235,991 issued to Minneman on Aug. 17, 1993. The mouthguard disclosed in this reference is a laminated structure, including a stiff, inner portion and having an outer compressible portion. The compressible portion is designed to be bitten into by the user in order to provide cushioning against damage to the occlusal surfaces of the teeth and also to reduce the mechanical shock forces transmitted through the mandible. The compressible material may be polyethylene foam or a polystyrene plastic, such as STYROFOAM. This mouthguard, however, does not provide protection from damage to the buccal or labial surfaces of the teeth that is commonly experienced from external impacts during sports activities. The Minneman mouthguard is not an athletic mouthguard, but intended as a medical appliance to be used with shock therapy during which the patient experiences the forcible contracture of the jaws for the duration of the shock's stimulus.

Another prior art mouthguard is disclosed in U.S. Pat. No. 4,955,393 issued to Adell on Sept. 11, 1990. This mouthguard has upper and lower troughs which generally conform to the upper and lower dental arches of the user. The troughs are rigid, but they include liners of soft, curable impression material for conformance to the actual impressions of the teeth. This mouthguard also includes air/saliva ducts which extend in the lingual/buccal direction to establish fluid communication to the outside of the user's mouth. While this mouthguard provides conformability to the particular shape of the user's individual teeth, there is no adjustability for the general shape of the dental arch; hence, this mouthguard cannot fit mouths of different sizes. Moreover, the Adell mouthguard must be specially packaged and kept sealed against moisture to prevent premature curing of the impression material.

Athletic mouthguards to protect teeth and gums from injury are widely available as either "boil and bite" custom-fitting mouthguards or professionally-fitted custom mouthguards which cost in the range of $75–$150. Both of these prior art guards are made of ethyl vinyl acetate. The drawback of these mouthguards is that they are extremely expensive, especially when they need to be replaced often as in the case of children whose continuing growth and development causes frequent dimensional changes in the oral structures. Such changes often are of the magnitude that a mouthguard may no longer fit within months, or even weeks, after fabrication. Also, patients receiving active orthodontic treatment undo dental spatial relationship changes in relatively short time periods.

There is therefore a need in the art for an inexpensive, yet highly effective, mouthguard. Also, its low cost could easily lead to its use as a disposable guard and, hence, more sanitary due to each individual guard's fewer number of uses. Finally, there is a need for a mouthguard which provides sufficient flexibility to be adaptable to different sized mouths or changes in mouth structure due to growth or use of orthodontics.

SUMMARY OF THE INVENTION

In order to fulfill the needs in the art described above, the present two-piece mouthguard assembly has been invented. Because the mouthguard is constructed of two separate flat pieces of cushioning material, it can be produced, packaged and shipped very inexpensively. Because of its low cost, it may be used as a "disposable" mouthguard.

The present mouthguard comes in two pieces of flat cushioning material which contain pre-formed notches, cutouts and holes as will be further described herein. This construction permits the separate pieces to be fitted together into the proper shape and configuration of a mouthguard.

A horseshoe-shaped bite plate member includes a pair of left and right curved slots and a frontal interlocking tab joint which secures the bite plate member to a vertical member which, after assembly, assumes the approximate shape of the dental arch. The vertical member includes a centrally-located slot which receives the interlocking tab on the bite plate member. The mouthguard is assembled by inserting the tab through the slot and positioning the vertical member into the bite plate member receiving slots. As an additional feature, a handgrip projects from the front of the bite plate member which includes an aperture that may be used to secure a tether.

More specifically, the applicants have invented a mouthguard assembly of two parts, comprising: a first vertical member, including a female attachment means unitary therewith; and a second horseshoe-shaped bite plate member attachable to the first member, the second member including male attachment means unitary therewith, and further including one or more slots for receiving the first member. The first member is joined to the second member to provide an assembled mouthguard by the insertion of the male attachment means through the female attachment means and the insertion of a main portion of the first member into the curved slots. The first and second members are planar in their unassembled state and are composed of a polyolefin foam. The female attachment means is a rectangular frontal keyhole. The male attachment means is a deformable T-shaped tab having a shank and an enlarged head portion. At the end of the shank opposite the head portion, a living hinge connects the tab with the rest of the bite plate member. After assembly, a portion of the bite plate member extends outwardly beyond the outer surface of the first vertical member along an arch providing a blow-cushioning bumper. A handle which is unitary with the bite plate member is centrally located and projects frontally from the outside surface of the first vertical member. When properly worn intraorally, the second bite plate member of the mouthguard assembly is positioned in the wearer's bite and the first vertical member is positioned between the external surface of the teeth and the inside surface of the cheeks.

Other objects, advantages and novel features of the invention will become apparent from the following detailed description of the invention when considered in conjunction with the accompanying drawings.

DESCRIPTION OF THE PREFERRED EMBODIMENT

Figure 1:
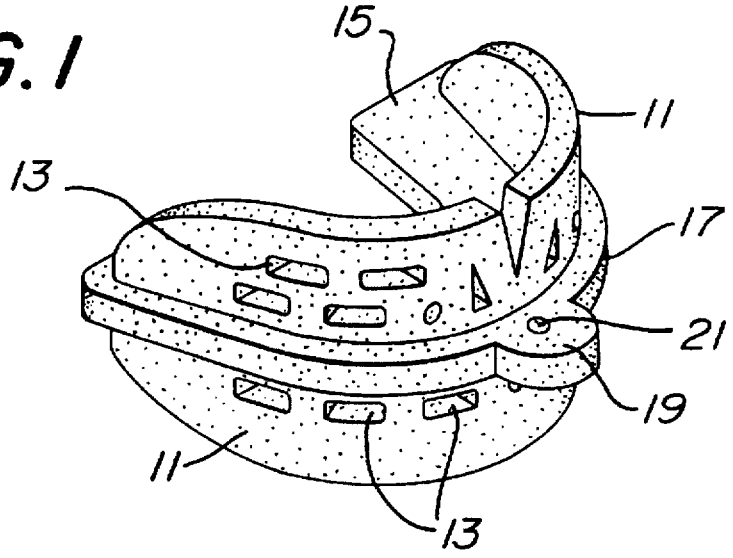
FIG. 1 is a top left isometric view of the present invention.
Figure 2:
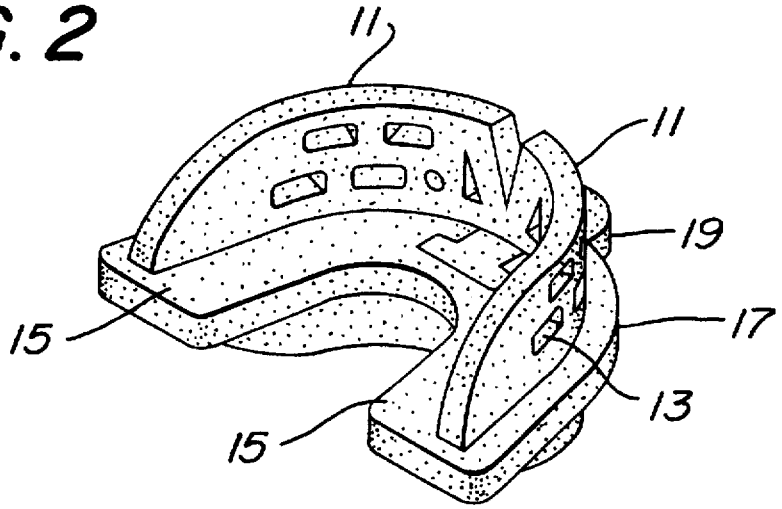
FIG. 2 is a top left rear view of the present invention.

Referring now to FIGS. 1 and 2, the mouthguard of the present invention includes two separate components which, when assembled, form the mouthguard as shown in this figure. After assembly, the mouthguard includes a first curved vertical member 11 which is generally shaped to conform to the wearer's dental arch. The vertical member includes a plurality of breathing ducts 13. These ducts also allow for transmission of saliva between the front and back surfaces of the mouthguard. The second part of the assembly is a horizontally disposed horseshoe-shaped bite plate member 15 which is interlocked with the vertical member 11 through the slots and tab interlock system described hereunder. The front edge of the bite plate member 17 provides a front-facing bumper which extends forward from the front surface of the vertical member. This bumper provides enhanced protection from a direct blow to the front of the mouth. Extending yet further from the bumper at the front of the bite plate member is a semicircular member 19 which provides a convenient handgrip for insertion and removal of the mouthpiece. The handgrip offers yet additional protection from a traumatic blow in the central incisor (midline) region. Aperture 21 which extends vertically through the handgrip provides a possible convenient point of attachment for a tether not shown in these figures.

Figure 5:
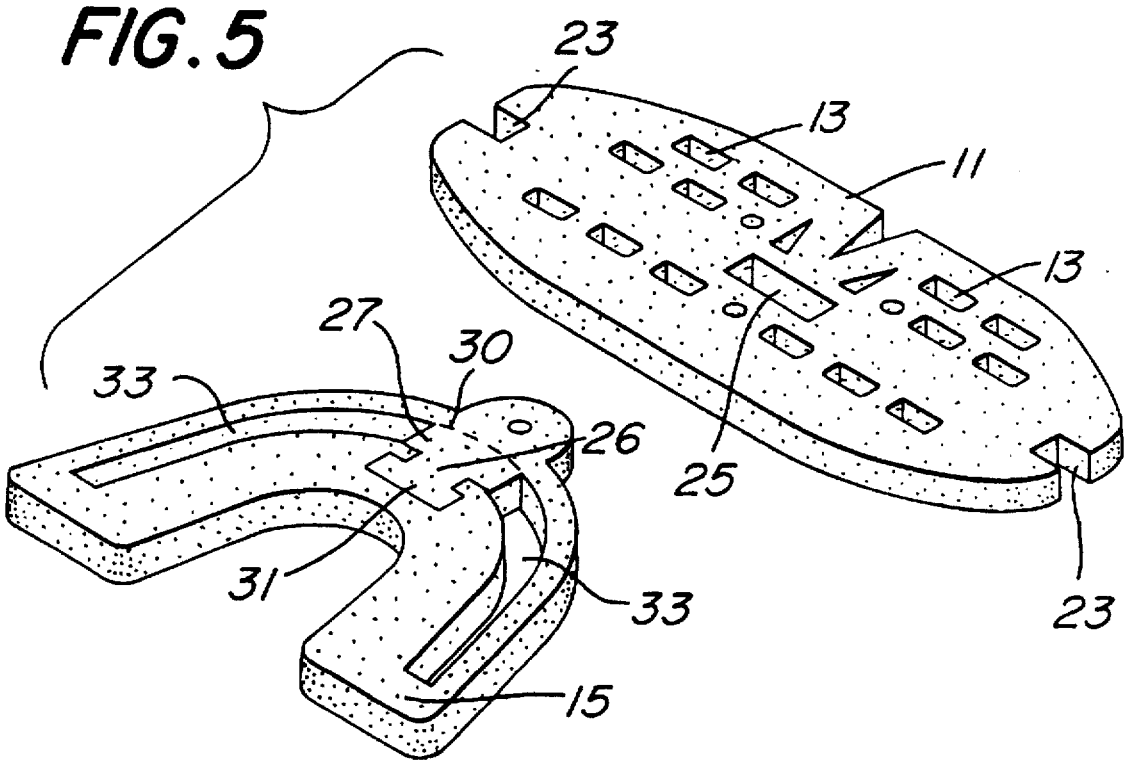
FIG. 5 is a top left rear isometric view of the components of the present invention shown separately.

Referring now to FIG. 5, the mouthguard of the present invention is shown in its unassembled condition. Both components are cut from flat pieces of material which provides for an extremely inexpensive means of production. The material used is preferably a polyolefin foam, for example, polypropylene or polyethylene of approximately ¼-inch thickness. The foam is dense but flexible, and can be manufactured in various colors, is comfortable, and non-irritating to oral soft tissues, and will not dissolve by oral fluids. Examples of such materials are foam products manufactured by the Voltek Company under the product names, MINICEL and VOLARA. Because the mouthguard is produced and sold in separate pieces, it also reduces the shipping volume if packaged and transported in its unassembled.

From FIG. 5, interlocking attachment means of both separate pieces can be clearly seen. Multiple duets 13 are cut completely through the vertical member. The vertical member 11 includes side notches 23 which interlock with the rear end wall of curved slots 33 in bite plate member 15. Member 11 further includes central keyhole 25 which together with corresponding T-shaped tab portion 27 in the bite plate member positively joins both members. The tab 27 is partially cut from the material of the bite plate member with the material at the base of the "T" 30 left uncut. The material in this area provides a "living hinge" which allows the tab to be easily deflected from the plane of the horizontal bite plate member material. An enlarged head portion 31 at the opposite end of the tab shank 26 strengthens the attachment. In use, the tab is first moved out of, and then back into, its own cavity in the material from which it was cut. This provides a puzzle-piece type interlocking joint that, once the tab is inserted through the keyhole and rejoined with its cutout, joins the vertical and bite plate members.

Figure 4:
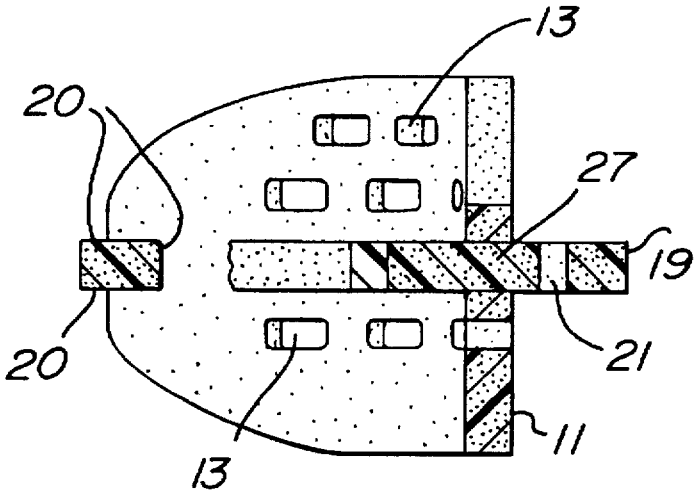
FIG. 4 is a side sectional view taken from FIG. 3 as shown in that figure.
Figure 3:
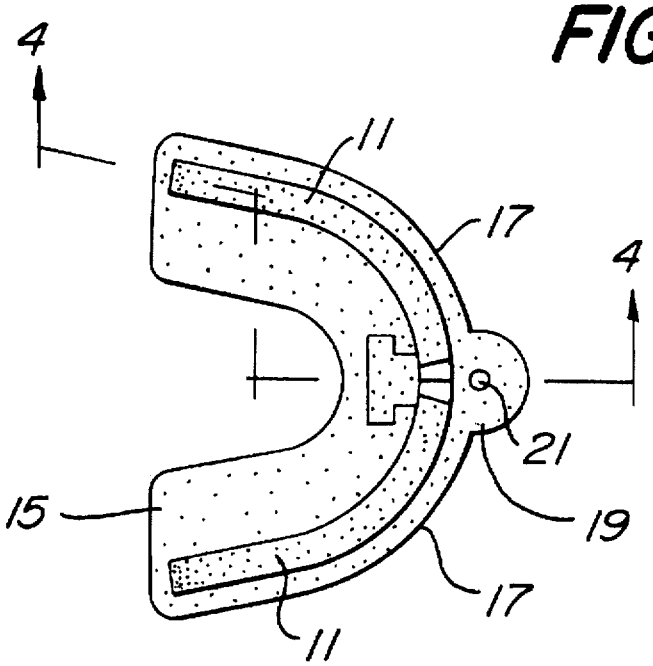
FIG. 3 is a top view of the present invention.

Referring now to FIG. 3, a top view of the present invention more clearly shows the shape of the front bumper portion 17 and the curved shape of the vertical member 11 when fitted into the curved slots of the bite plate member. Most clearly seen in this figure is forward extending semicircular handle portion 19 which includes aperture 21 for possible attachment to a tether (not shown). Yet further detail can be seen from the sectional view of this figure shown in FIG. 4 which more clearly shows the interlocking joint between the tab portion 27 on the bite plate member and frontal slot through the front of vertical member 11. The forward projecting handle with aperture 21 is also clearly shown in this figure. Further depicted are the interlocking engagement points 20 between the back wall of the right side slot in the bite plate member 15 with the inside surfaces of the side notches in the vertical member. Greater detail of the fluid ducts 13 in the vertical member is also shown in FIG. 4.

Referring again to FIG. 5, assembly of the present mouthguard from its two separate components is achieved as follows. First, T-shaped tab 27 on the bite plate member is separated from its interlocking cavity by simple manual deflection of the material which is preferably a very flexible cushion-like foam. Next, head 31 which extends rearward on tab 27 is inserted through keyhole 25 in the vertical member. Some deformation of the head is required to accomplish this. Next, the tab 27 is inserted back into its cutout. Then, the main body of the vertical member is inserted into curved notches 33 in the bite plate member. Finally, side notches 23 are snapped into place, engaging the back walls of the slots 33 and their surrounding material, i.e. the front and top surfaces of the bite plate member in that region. This brings the vertical member into an accurate path, approximating the shape of the wearer's dental arch.

The mouthguard of the present invention provides great superiority over prior art mouthguards. For example, it is adaptable to a wide range of mouth sizes and shapes. At room temperature, the foam molds itself to the teeth and dental arch shape by the gentle compressive action of the cheek and lip muscles. In additional, the foam is of such consistency that the horseshoe shape of the mouthguard can expand or contract to make a wider or narrower U-shape, depending upon the shape and size of the dental arches of most individuals. Ethyl vinyl acetate mouthguards do not have this ability. Further adaptability is possible using common scissors to cut away portions of either the vertical or bite plate members. Another advantage previously mentioned is the bumper region which extends forward beyond the plane of the interlocked vertical member to provide additional protection against direct frontal blows. Finally, its low cost should lead to a regularly disposable use that will promote enhanced sanitation.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

We claim:

1. A mouthguard assembly in two parts, comprising:

a first vertical member, including a female attachment means unitary therewith; and a second separate horseshoe-shaped bite plate member attachable to said first member, said second member including male attachment means unitary therewith, and further including one or more curved apertures for receiving and capturing the entire length of said first member, whereby said first member is held in a generally U-shape such that when worn, said first member is positioned intraorally between the wearer's teeth and cheeks.

2. The mouthguard assembly of claim 1, wherein said first and said second members are planar in their unassembled state.

3. The mouthguard assembly of claim 1, wherein said male attachment means comprises a deformable tab.

4. The mouthguard assembly of claim 3, wherein said tab is T-shaped having a shank and an enlarged head portion.

5. The mouthguard assembly claim 4, wherein said tab further includes a living hinge portion at the end of said shank of said tab opposite of said head portion.

6. The mouthguard assembly of claim 1, further including a plurality of ducts through said first vertical member.

7. The mouthguard assembly of claim 1, further described in that said first and second members are composed solely of a polyolefin foam.

8. An assembled mouthguard, comprising:

a first vertical member including a female attachment means unitary therewith;

a second member comprising a horseshoe-shaped bite plate attached to said first member, said second member including male attachment means unitary therewith, and further including one or more curved apertures for receiving and capturing the entire length of said first member, whereby said first member is held in a generally U-shape such that when worn, said first member is positioned intraorally between the wearer's teeth and cheeks; and an interlocking tab joint attaching said first and second members, said joint being accomplished by the insertion of said male attachment means through said female attachment means and the insertion of a main portion of said first member into said apertures of said second member.

9. The assembled mouthguard of claim 8, wherein said female attachment means is a frontal keyhole.

10. The assembled mouthguard of claim 9, wherein said keyhole is rectangular.

11. The assembled mouthguard of claim 8, further including an outward projecting bumper extending beyond the outside surface of said first vertical member along an arc, said bumper being a portion of said second bite plate member.

12. The assembled mouthguard of claim 8, further including handle means which is centrally located frontally and projects from the outside surface of said first vertical member, and said handle means further being unitary with said horizontal member.

13. The assembled mouthguard of claim 12, further including an aperture in said handle.

14. The assembled mouthguard of claim 8, further described in that when said mouthguard assembly is worn intraorally, the second member is positioned in the wearer's bite and the first member is positioned in abutment with the external surfaces of the wearer's teeth.

15. A mouthguard assembly of two parts, comprising:

a first vertical member, and a second separate horseshoe-shaped bite plate member attachable to said first member, said second member including one or more vertically-extending curved apertures for receiving and capturing the entire length of said first member, whereby said first member is held in a generally U-shape such that when worn, said first member is positioned intraorally between the wearer's teeth and cheeks.

* * * * *